US005836466A

United States Patent [19]

Briere et al.

[11] Patent Number: 5,836,466

[45] Date of Patent: Nov. 17, 1998

[54] SAFETY CLOSURE AND CONTAINER ASSEMBLY

[75] Inventors: Marc A. Briere, Newburgh; Christopher B. Clodfelter, Evansville; William D. Sprick, Evansville, all of Ind.

[73] Assignee: Rexam Plastics, Inc., Evansville, Ind.

[21] Appl. No.: 861,793

[22] Filed: May 22, 1997

[51] Int. Cl.[6] ..... B65D 55/02

[52] U.S. Cl. ..... 215/216; 215/217

[58] Field of Search ..... 215/216, 217, 215/219, 330, 218, 221, 222

[56] References Cited

U.S. PATENT DOCUMENTS

| | | | |
|---|---|---|---|
| 3,399,796 | 9/1968 | Steiner . | |
| 3,445,022 | 5/1969 | Cilluffo . | |
| 3,794,200 | 2/1974 | Marks . | |
| 3,848,761 | 11/1974 | Libit . | |
| 3,934,744 | 1/1976 | Curry . | |
| 3,949,893 | 4/1976 | Uhlig . | |
| 3,984,021 | 10/1976 | Uhlig | 215/217 X |
| 3,993,208 | 11/1976 | Ostrowsky . | |
| 3,993,209 | 11/1976 | Julian . | |
| 4,037,747 | 7/1977 | Acton et al. . | |
| 4,213,534 | 7/1980 | Montgomery | 215/216 |
| 4,345,690 | 8/1982 | Hopley | 215/216 |
| 4,351,443 | 9/1982 | Uhlig | 215/216 |
| 4,413,743 | 11/1983 | Summers . | |
| 4,456,136 | 6/1984 | Pa'Lsson . | |
| 4,756,435 | 7/1988 | Schick et al. . | |
| 5,292,020 | 3/1994 | Narin . | |
| 5,460,281 | 10/1995 | Rapchak et al. . | |
| 5,462,182 | 10/1995 | Opresco . | |
| 5,560,505 | 10/1996 | Schneider et al. | 215/216 X |

FOREIGN PATENT DOCUMENTS

| | | | |
|---|---|---|---|
| 90/02692 | 3/1990 | WIPO | 215/217 |

*Primary Examiner*—Stephen K. Cronin
*Assistant Examiner*—Nathan Newhouse
*Attorney, Agent, or Firm*—Middleton & Reutlinger; Daniel C. Stelter, Esq.

[57] ABSTRACT

A safety closure and container assembly provided with a safety closure having a top wall and a downwardly-depending annular skirt. A pair of opposed, inwardly-projecting locking lugs are disposed on an inner surface of the annular skirt towards the lower end thereof. The locking lugs are radially offset from the squeeze pads by about 90° and are furthermore sized to engage a pair of cooperating locking tabs provided on the container neck. The locking lugs are back-angled and form an interior angle of at least 30° with an imaginary line extending inwardly and normally from the inner surface of the annular skirt at respective base ends of the locking lugs. The safety closure further includes annular slots disposed at an approximate axial midpoint of the annular skirt. The annular slots are located unsymmetrically between the locking lugs and the squeeze pads and are disposed through an arcuate distance of about 75° beginning about 13° from a centerpoint of each squeeze pad and extending in the direction of each respective locking lug. A safety closure is even further provided with a retaining bead projecting inwardly and downwardly from the inner surface of the annular skirt near a top end thereof. Within a recess created between the retaining bead and the top wall, a sealing gasket may be positioned to provide an enhanced liquid-impervious seal between the safety closure and the container.

29 Claims, 10 Drawing Sheets

SAFETY CLOSURE AND CONTAINER ASSEMBLY

BACKGROUND OF THE INVENTION

1. Technical Field of the Invention

The present invention relates to safety closures and containers used in combination with one another to prevent easy access to the contents of the container. More particularly, the present invention relates to safety closures and containers used in combination with one another having cooperating locking lugs to prevent removal of the safety closure from the container.

2. Discussion of the Prior Art

The use of cooperating locking lugs on safety closures and containers to prevent small children from gaining access to the contents of the container is relatively well-known in the prior art. Typically, a safety closure is provided with a flexible annular skirt having an inner annular surface thereof with a pair of opposed, inwardly-projecting locking lugs. Additionally, a container is provided with a container neck portion having on an exterior surface thereof a pair of opposed, outwardly-projecting locking tabs. A safety closure of this type is threadingly engaged on the container neck until the locking lugs pass over and beyond their respective cooperating locking tabs, thereby causing interference therebetween and preventing removal rotation of the safety closure relative to the container neck.

Generally, an adult can manipulate the locking lugs to overcome their respective interfering locking tabs by applying sufficient inwardly-projected radial forces at opposed locations on an outer surface of the safety closure annular skirt between the locking lugs. For example, when inwardly-projected radial forces are applied at opposed locations on the safety closure annular skirt offset from the locking lugs by about 90°, the safety closure annular skirt is distorted inwardly at these locations, thereby distorting the safety closure outwardly at locations near the locking lugs. This outward distortion causes an innermost point of the locking lugs to move beyond an outermost point of their respective locking tabs, thereby eliminating any interference therebetween. If removal rotational force is applied simultaneously with the inwardly-projected radial forces, the locking lugs are permitted to pass freely over the locking tabs, thereby permitting the safety closure to be rotated relative to the container and removed therefrom.

However, if sufficient rotational force is applied to the safety closure without first applying the required inwardly-projected radial forces necessary to radially move the locking lugs beyond their respective locking tabs, the interfering lugs and tabs will abut one another with sufficient force until one or the other is itself deformed, thereby stripping it. The locking lugs are thus permitted to pass over their respective locking tabs without first imparting radial distortion of the safety closure annular skirt. This typically results in permanent damage to the shape of the lugs and tabs, and renders the safety closure incapable of properly providing a child-resistant feature.

Further, although the prior art recognizes that annular slots may be provided in the safety closure annular skirt to reduce the radial force required to impart radial distortion thereto, slots as heretofore known are generally disposed equidistantly and substantially between the points at which radial forces are to be applied. Such placement of the slots, although reducing the amount of force required to distort the annular skirt, do not reinforce the locking lugs or otherwise prevent the above-described lug stripping.

A typical safety closure of the prior art is U.S. Pat. No. 3,993,209 to Julian, which teaches a child-resistant cap is taught having a locking collar connected to an annular closure skirt by two axially-extending annular webs. A pair of annular slots are located equidistantly and substantially between the webs, thereby reducing the radial force required to distort a thin band of skirt material extending axially below such webs. Such an annular band, however, does not provide any reinforcement to prevent stripping of either the locking lugs or the locking tabs.

SUMMARY OF THE INVENTION

Accordingly, it is an object of the present invention to provide a safety closure and container assembly to prevent easy access to the contents of the container.

It is another object of the present invention to provide a safety closure and container assembly having cooperating back-angled locking lugs.

A further object of the present invention is to provide a safety closure and container assembly wherein the amount of inwardly-projected force required to sufficiently distort and remove the safety closure from the container is reduced by providing a safety closure annular skirt having an exterior surface upon which a pair of opposed oversized thumb pads are provided offset from a pair of back-angled locking lugs provided on an inner surface of the safety closure annular skirt.

It is still even another object of the present invention to provide a safety closure and container assembly wherein the amount of inwardly-projected force required to sufficiently distort and remove the safety closure from the container is reduced by providing a safety closure annular skirt having annular slots provided therethrough.

It is also an object of the present invention to provide a safety closure and container assembly for use in combination with one another and wherein the combined use thereof creates a liquid-impervious seal.

A safety closure and container assembly according to the present invention is provided with a safety closure having a top wall and a downwardly-depending annular skirt. A pair of opposed, inwardly-projecting locking lugs are located on an inner surface of the annular skirt towards the lower end thereof. The locking lugs are radially offset from the squeeze pads by about 90° and are furthermore sized to engage a pair of cooperating locking tabs provided on the container neck. The locking lugs are back-angled and form an interior angle of at least 30° with an imaginary line extending inwardly and normally from the inner surface of the annular skirt at respective base ends of the locking lugs.

A safety closure according to the present invention is further provided having annular slots disposed at an approximate axial midpoint of the annular skirt. The annular slots are located unsymmetrically between the locking lugs and the squeeze pads and are disposed through an arcuate distance of about 75° beginning about 13° from a center-point of each squeeze pad and extending in the direction of each respective locking lug.

A safety closure according to the present invention even further provides for a retaining bead projecting inwardly and downwardly from the inner surface of the annular skirt near a top end thereof. Within a recess created between the retaining bead and the top wall, a sealing gasket may be positioned to provide an enhanced liquid-impervious seal between the safety closure and the container.

BRIEF DESCRIPTION OF THE DRAWINGS

A better understanding of the present invention will be had upon reference to the following description in conjunction with the accompanying drawings in which like numerals refer to like parts, and wherein.

DETAILED DESCRIPTION OF THE PREFERRED EMBODIMENT

Figure 1:
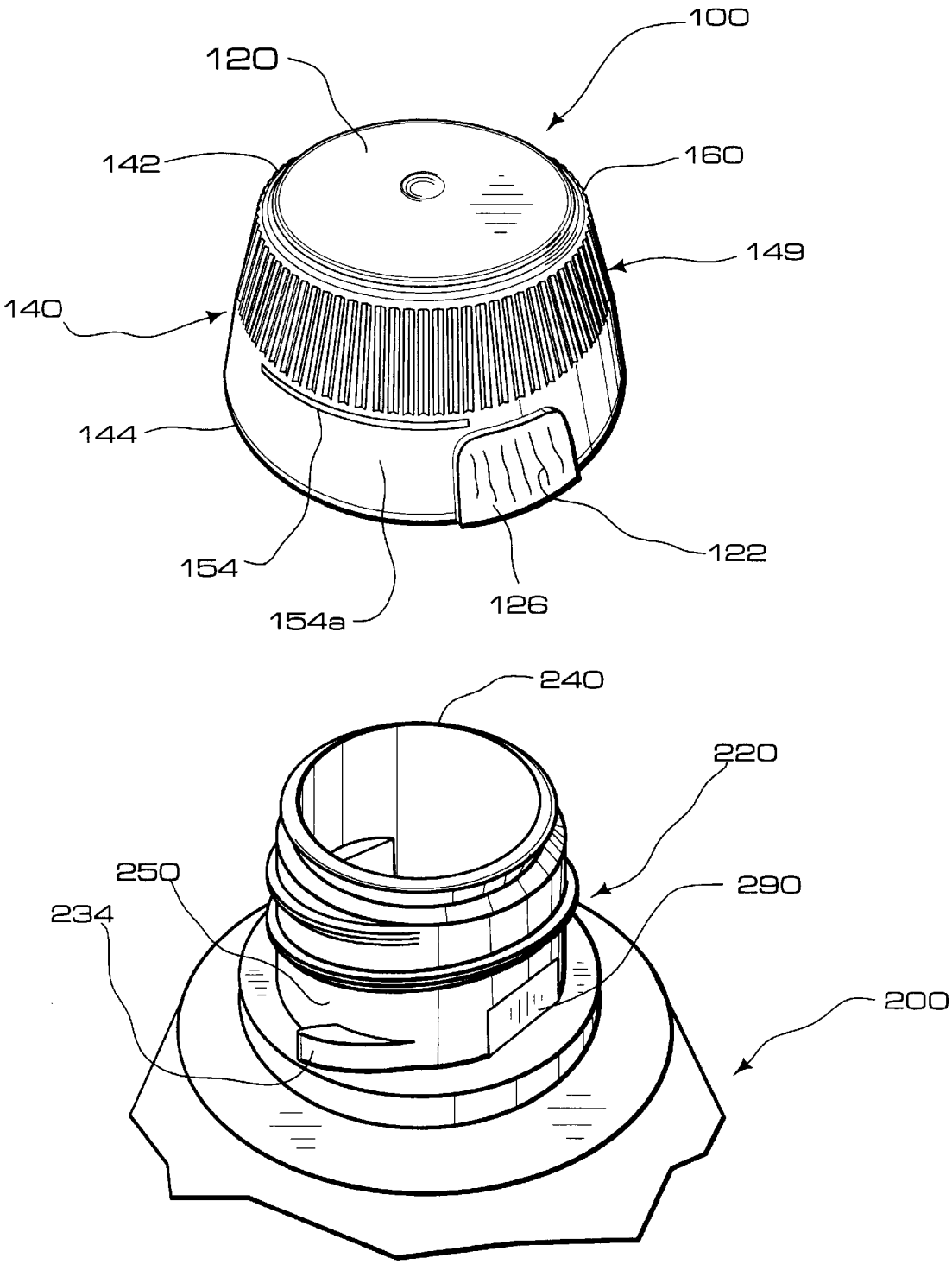
FIG. 1 is a top perspective view of a preferred safety closure of the present invention in spaced relation to a preferred container of the present invention.

With reference to FIG. 1, there is shown in spaced relation to a preferred safety closure 100 for use with a preferred container 200 having a neck portion 220. The safety closure 100 includes a top wall 120 and an annular skirt 140 depending downwardly from an outer perimeter 160 of the top wall 120. The annular skirt 140 includes an upper end 142 coincident with the outer perimeter 160 of the top wall 120 and a lower end 144 opposite the upper end 142. Typically, the safety closure 100 and the container 200 of the present invention are made from injection-molded polypropylene, although any suitable, similar material may be substituted therefor, such as, for example, polyvinyl chloride. Further, a safety closure 100 and container 200 of the present invention may be formed by any suitable process, such as, for example, by blow-molding or by extrusion-molding.

Figure 2:
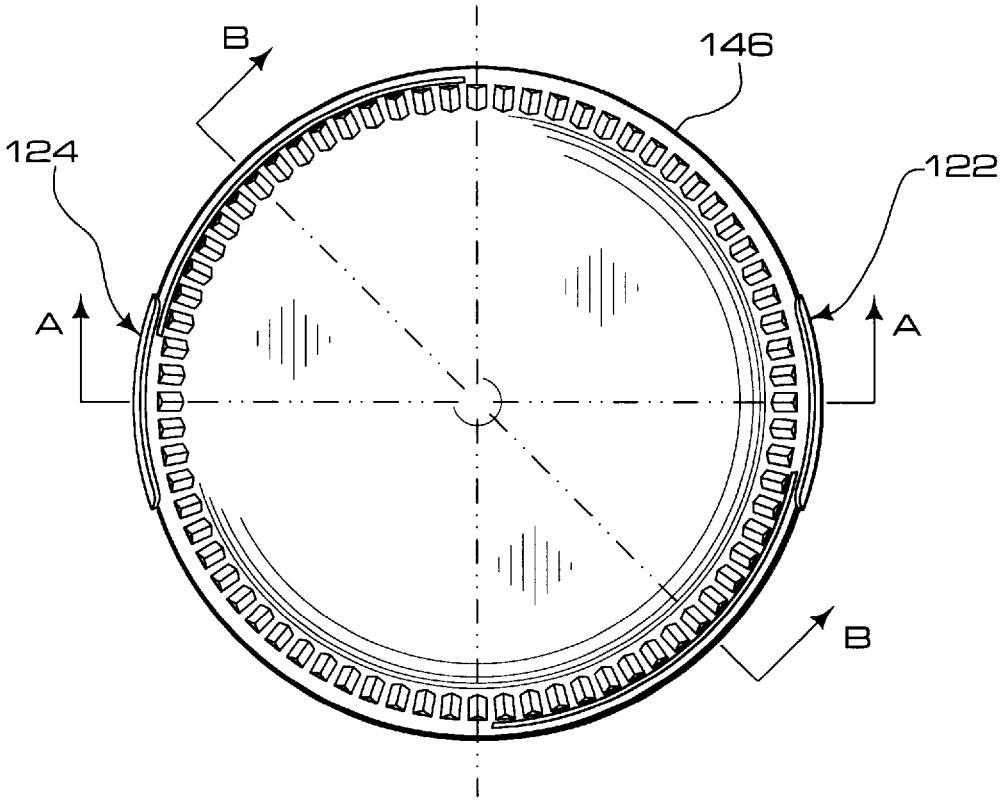
FIG. 2 is a top view of the preferred safety closure of FIG. 1.
Figure 3:
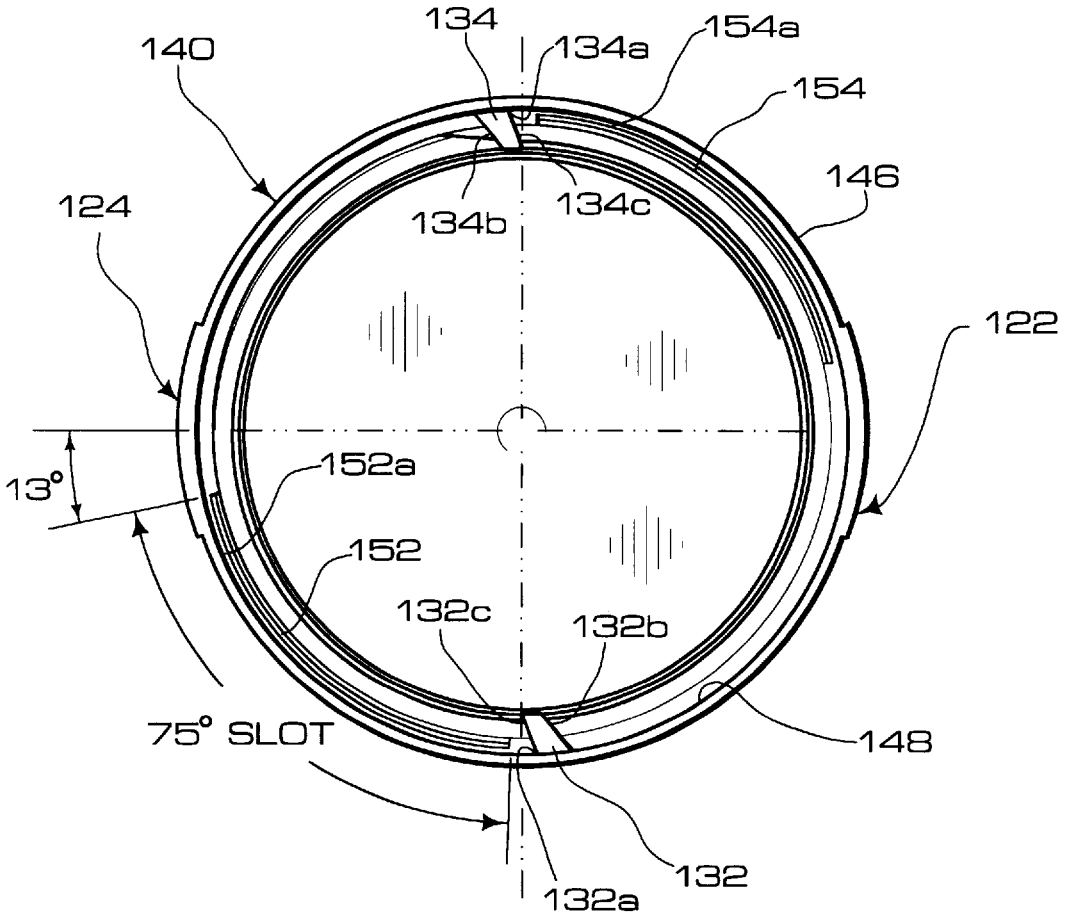
FIG. 3 is a bottom view of the preferred safety closure of FIG. 1.

With combined reference to FIGS. 1–3, the safety closure 100 includes a pair of opposed squeeze pads 122 and 124 disposed towards the lower end 144 of the annular skirt 140 on an exterior surface 146 thereof. The squeeze pads 122 and 124 are oversized, and have an average thickness which is greater then a thickness of the annular skirt 140 in a region surrounding the squeeze pads 122 and 124. Alternatively, the annular skirt 140 may have a variable wall thickness in an area surrounding the squeeze pads 122 and 124. Further, the squeeze pads 122 and 124 may be provided with axial knurls 126. As such, the exterior surface 146 of the annular skirt 140 is discontinuous in the regions surrounding the squeeze pads 122 and 124, thereby providing an oversized gripping surface to aid a user in securing or removing the safety closure 100 from the container neck 200.

Figure 4:
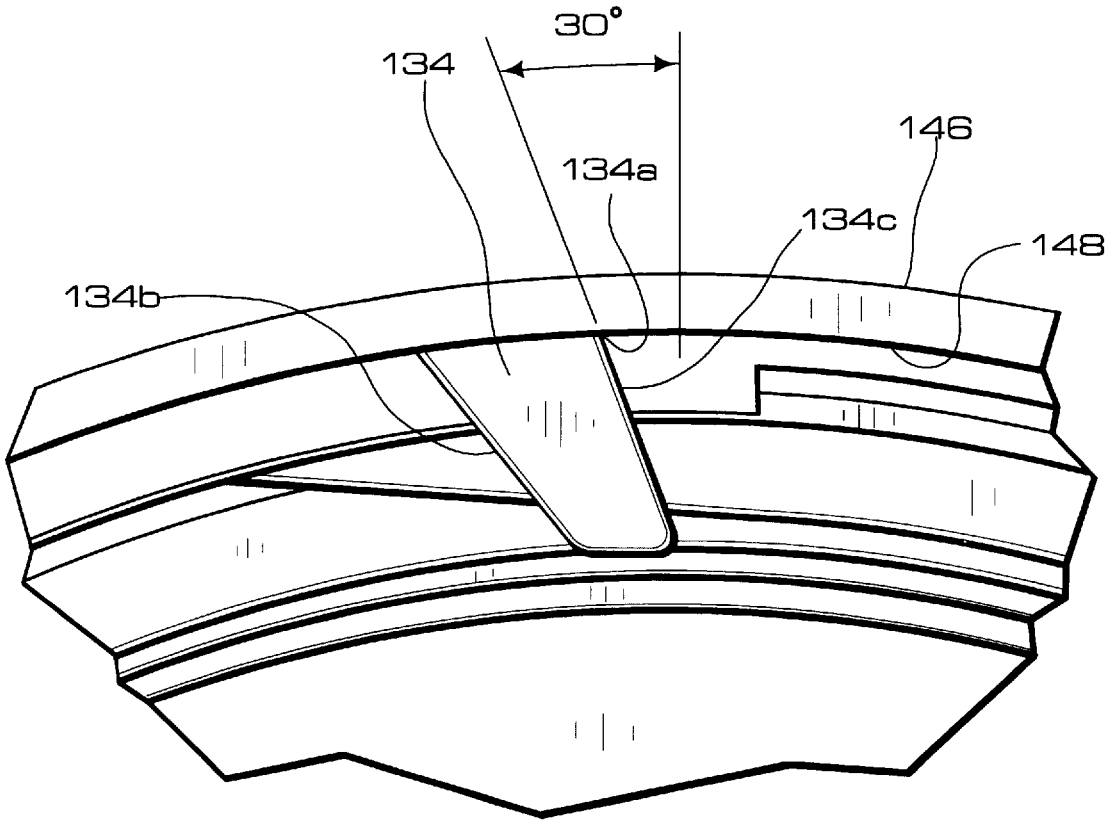
FIG. 4 is an enlarged perspective view of one element of FIG. 3.
Figure 6:
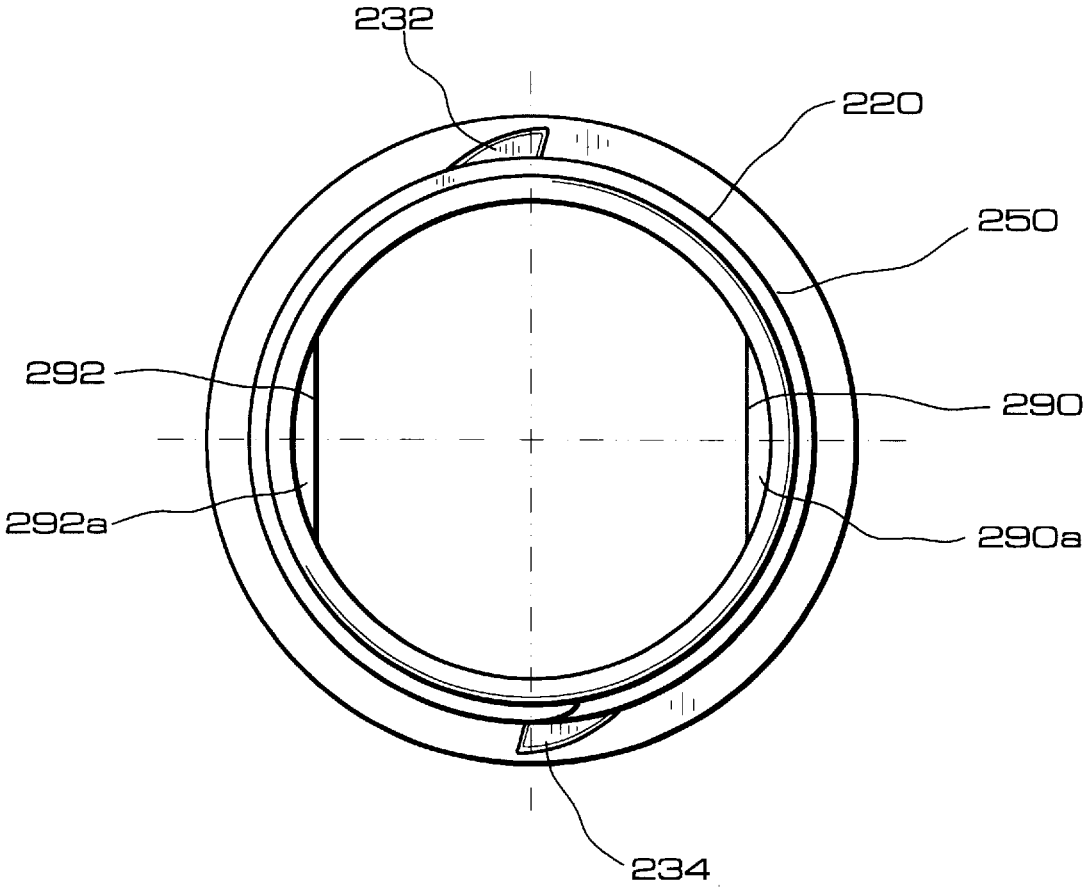
FIG. 6 is a top view of the preferred container of FIG. 1.

With combined reference to FIGS. 3 and 4, a pair of opposed, inwardly-projecting locking lugs 132 and 134 are located on an inner surface 148 of the annular skirt 140 towards the lower end 144 thereof. The locking lugs 132 and 134 are radially offset from the squeeze pads 122 and 124 by about 90° and are furthermore sized to engage a pair of cooperating locking tabs 232 and 234 provided on the container neck (FIG. 6). The locking lugs 132 and 134 are back-angled and form respective interior angles of at least 30° with imaginary lines extending inwardly and normally from the inner surface 148 of the annular skirt 140 near respective base ends 132*a* and 134*a* of the respective locking lugs 132 and 134. The locking lugs 132 and 134 may be provided with lug ramping surfaces 132*b* and 134*b*. Alternatively, the inwardly-projecting locking lugs 132 and 134 may be replaced with downwardly-depending locking lugs (not shown) extending axially downwardly from the lower end 144 of the annular skirt 140.

With combined reference to FIGS. 1 and 3, a pair of annular slots 152 and 154 are provided at the approximate axial midpoint of the annular skirt 140, although the present invention contemplates the positioning of the annular slots 152 and 154 to depend upon the particular size of the squeeze pads 122 and 124. For example, the annular slots 152 and 154 need only be axially positioned on the annular skirt 140 such that the annular slots 152 and 154 are slightly nearer the upper end 142 of the annular skirt 140 than are the squeeze pads 122 and 124.

Figure 5:
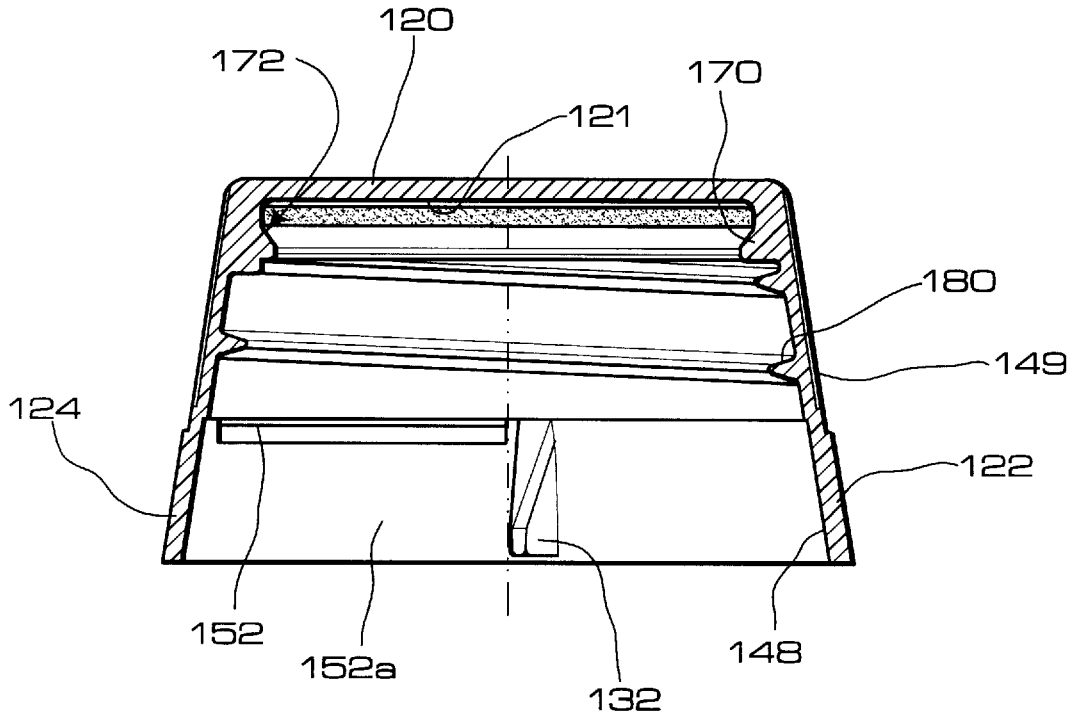
FIG. 5 is a sectional view of the preferred safety closure taken along the line A—A of FIG. 2.

Preferably, and with additional reference to FIG. 5, the annular slots 152 and 154 are disposed through an arcuate distance of about 75° beginning about 13° from the squeeze pads 122 and 124 and extending towards the locking lugs 132 and 134. The annular slots 152 and 154 thereby define a pair of annular bands 152*a* and 154*a* in the annular skirt 140 between the annular slots 152 and 154 and the lower end 160 of the annular skirt 140.

Figure 7:
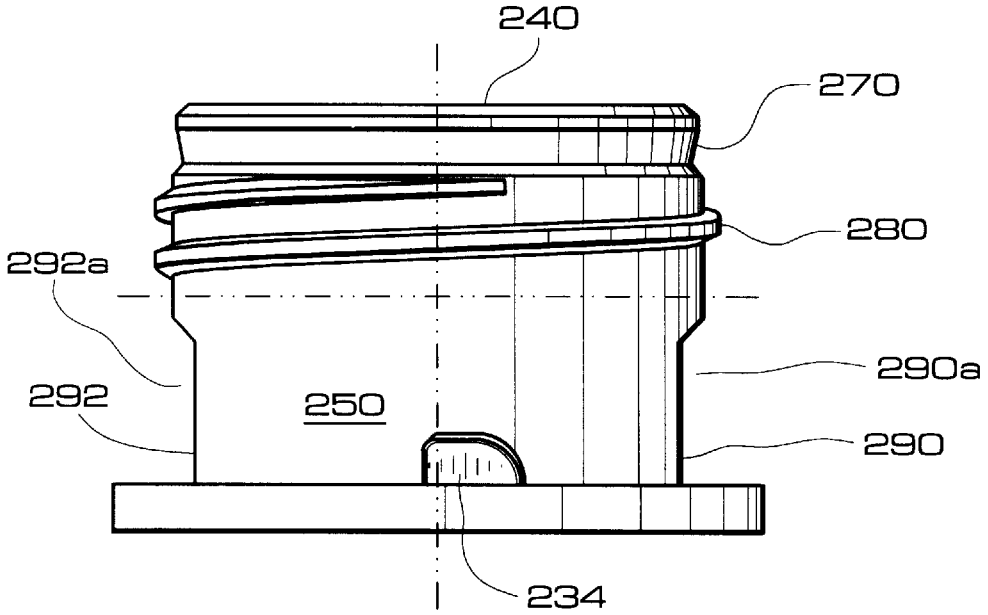
FIG. 7 is a side elevation view of the preferred container of FIG. 6.

An endless retaining bead 170 is provided on the inner surface 148 of the annular skirt 140 towards the top end 142 thereof. The endless retaining bead 170 extends downwardly and inwardly from the top end 142 of the annular skirt 140, forming a recess 172 between a lower surface 121 of the top wall 120 and the retaining bead 170. The retaining bead 170 is sized to engage a cooperating retaining lip 270 provided on a terminal end 240 of the container neck 240 (FIG. 7). A gasket (not shown) may also be provided between the retaining lip 270 and the lower surface 121 of the top wall 120 to create a fluid-impervious seal between the container 200 and the safety closure 100.

An internal thread 180 is provided on the inner surface 148 of the annular skirt 140 between the annular slots 152 and 154 and the retaining bead 170. The exterior surface 146 of the annular skirt 140 adjacent the internal thread 180 may be provided with circumferentially spaced axial knurls 149 to provide an enhanced slip-free gripping surface.

With combined reference to FIGS. 1 and 6, container neck 220 includes a pair of opposed locking tabs 232 and 234 extending outwardly from an exterior surface 250 of the container neck 220.

With reference to FIG. 7, the container neck 220 includes a terminal end 240 having an outwardly-extending continuous lip 270. An external thread 280 is provided on the exterior surface 250 of the container neck 220 near the terminal end 240 thereof and is sized to threadingly engage the safety closure internal thread 180. Opposed flattened surfaces 290 and 292 are provided on the exterior surface 250 of the container neck 220 offset from the locking tabs 232 and 234 by about 90° to provide respective receiving areas 290*a* and 292*a* for the safety closure thumb pads 122 and 124.

Figure 8:
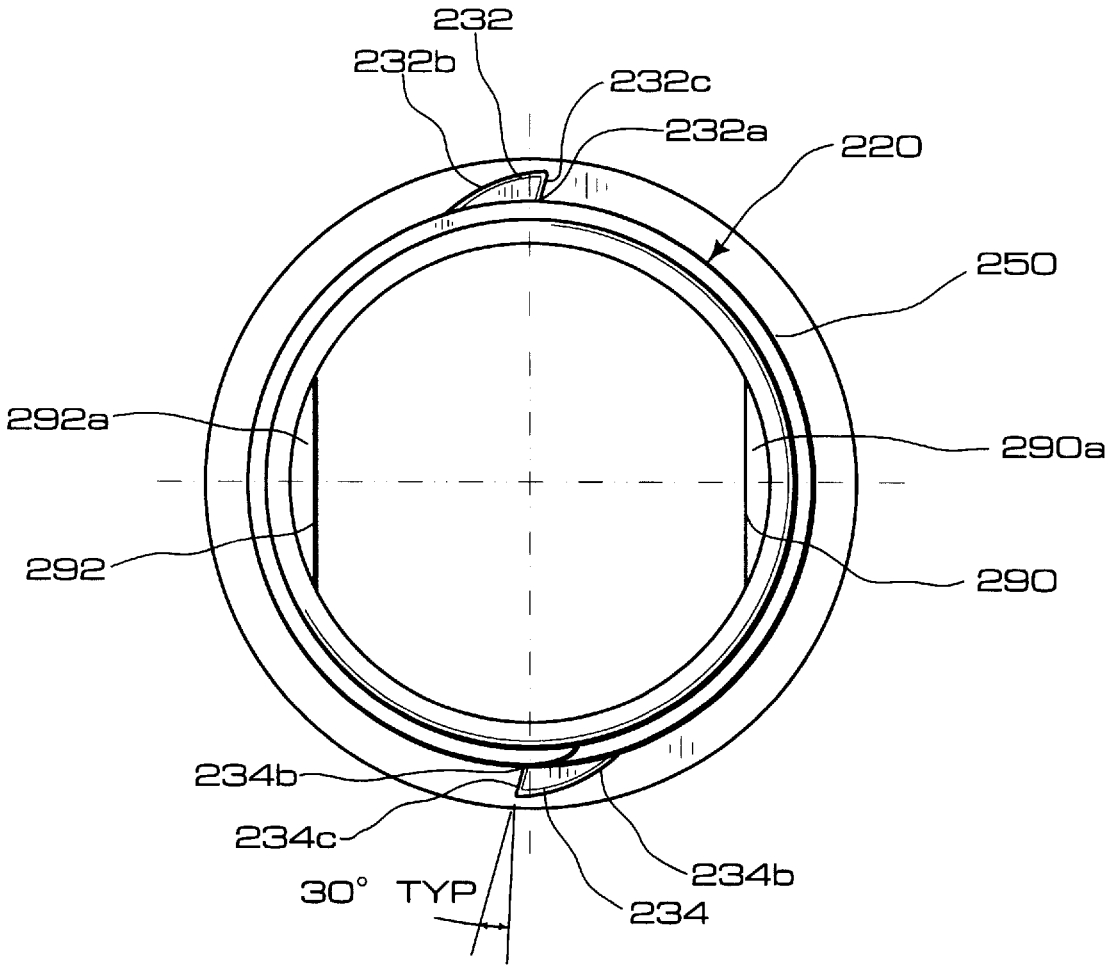
FIG. 8 is a top view of the preferred container of FIG. 1.

With additional reference now to FIG. 8, the locking tabs 232 and 234 are shown in detail and are sized to engage a pair of cooperating locking lugs 132 and 134 provided on the inner surface 148 of the safety closure 100 (FIG. 3). The locking tabs 232 and 234 are back-angled and form respective interior angles of at least 30° with imaginary lines extending outwardly and normally from the exterior surface 250 of the container neck 220 at respective base ends 232*a* and 234*a* of the respective locking tabs 232 and 234. The locking tabs 232 and 234 may also be provided with tab ramping surfaces 232*b* and 234*b*.

A preferred safety closure 100 and a preferred container 200 of the present invention are used in combination with one another as follows. The safety closure 100 is aligned with the container 200 and the safety closure internal thread 180 is engaged with the container external thread 280. The safety closure 100 is rotated in a first downward direction until the safety closure lug ramping surfaces 132*b* and 134*b* meet and abut their respective container tab ramping surfaces 232*b* and 234*b*. Additional downward rotation is applied to the safety closure 100, whereby the abutting ramping surfaces 132*b*, 134*b*, 232*b* and 234*b* cause the flexible annular skirt 140 to distort outwardly. Once sufficient downward rotation is applied to permit the locking lugs 132 and 134 to pass beyond their respective locking tabs 232 and 234, the annular skirt 140 resumes its original shape, whereby the locking lugs 132 and 134 are drawn inwardly behind their respective locking tabs 232 and 234, thereby creating an interference therebetween. Removal rotation in a direction opposite the direction of the downward rotation is prevented by the interference between abutting rear surfaces of the locking lugs 132*c* and 134*c* (FIG. 3) and respective rear surfaces of the locking tabs 232*c* and 234*c* (FIG. 8). Further, the cooperating back angle of the locking lugs 132 and 134 and the locking tabs 232 and 234 results in a tight engagement therebetween, thereby reducing the likelihood of the locking lugs 132 and 134 from potentially skipping over their respective locking tabs 232 and 234.

The retaining bead 170 is positioned on the inner surface 148 of the annular skirt 140 such that at approximately the same time that the locking lugs 132 and 134 are drawn behind their respective locking tabs 232 and 234, the container retaining lip 270 snaps into the recess 172 formed between the retaining bead 170 and the lower surface 121 of the top wall 120. Thus, a locked, child-resistant, liquid-impervious fit results between the safety closure 100 and the container 200.

Figure 9:
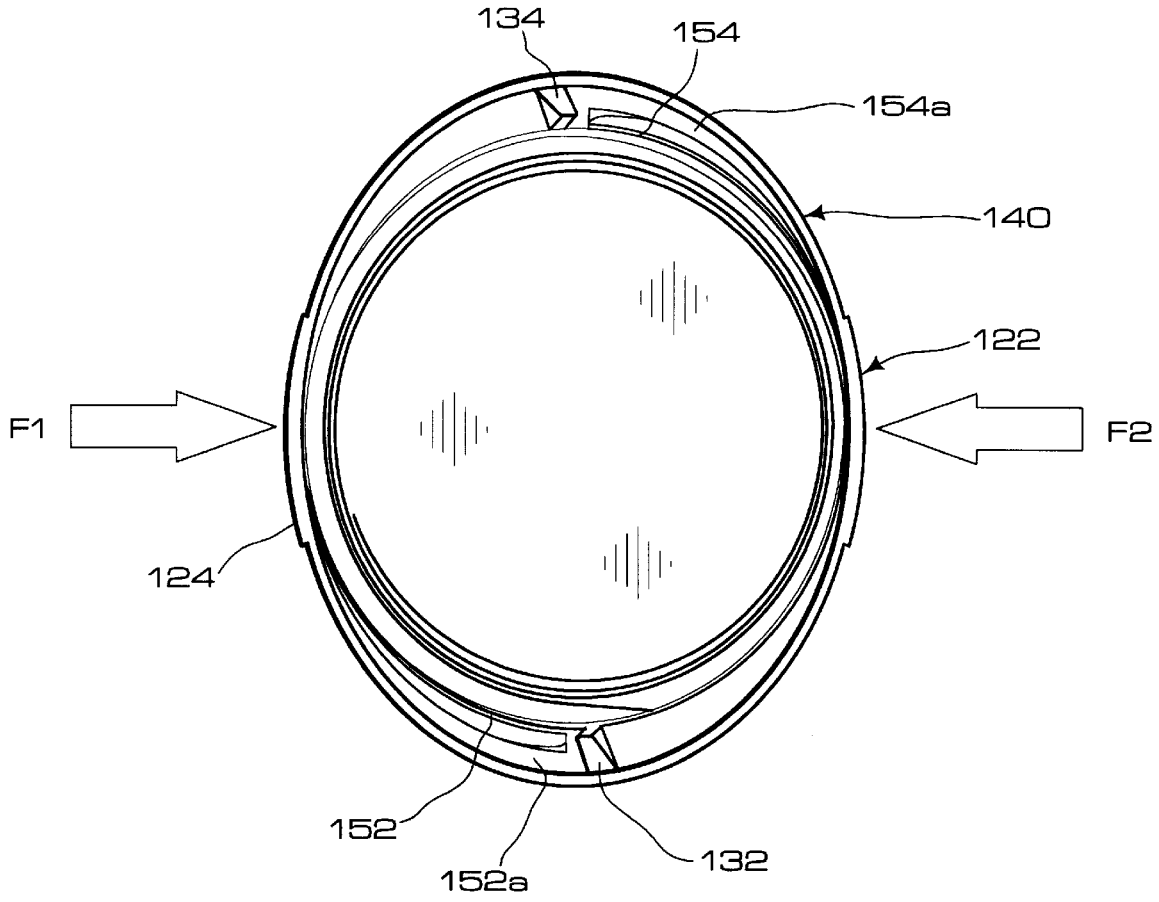
FIG. 9 is a bottom view of the preferred safety closure of FIG. 2, showing distortion of the annular skirt; and, FIG. 10 is a sectional view of the preferred safety closure taken along line B—B of FIG. 2.

With reference to FIG. 9, removal of the safety closure 100 from the container 200 is shown and requires the user to first overcome the interference created by the abutting locking lugs 132 and 134 with their respective locking tabs 232 and 234. This is achieved by the user first applying inwardly-projecting radial forces $F_1$ and $F_2$ to the thumb pads 122 and 124, thereby distorting the annular skirt 140 inwardly at the locations of forces $F_1$ and $F_2$ and outwardly at locations offset from forces $F_1$ and $F_2$ by about 90°. The receiving areas 290*a* and 292*a* formed by the flattened surfaces 290 and 292 on the container neck 220 permit the annular skirt 140 to be distorted inwardly at the thumb pads 122 and 124. Once the annular skirt 140 is distorted outwardly sufficiently to permit the locking lugs 132 and 134 to pass over their respective locking tabs 232 and 234, further removal rotational force is applied to the safety closure 100 until the safety closure 100 is removable from the container 200.

The safety closure 100 and the container 200 of the present invention provide enhanced locking features by the cooperation of the oversized thumb pads 122 and 124, the unsymmetrical annular slots 152 and 154, the back-angled safety closure locking lugs 132 and 134, and the back-angled container locking tabs 232 and 234. In particular, the oversized thumb pads 122 and 124 provide efficient gripping surfaces and reduce the amount of force $F_1$ and $F_2$ which must be applied to achieve sufficient outward distortion of the annular skirt 140 required to permit the locking lugs 132 and 134 to pass over their respective locking tabs 232 and 234. Further, the increased thickness of the thumb pads 122 and 124, as compared to the general wall thickness of the annular skirt 140, stiffens the annular skirt 140 within the areas immediately surrounding the thumb pads 122 and 124, thereby more efficiently transmitting the applied forces $F_1$ and $F_2$ from the thumb pads 122 and 124 to the annular bands 152*a* and 154*a*.

The unsymmetrical slots 152 and 154, and more particularly, the annular bands 152*a* and 154*a*, further reduce the amount of force $F_1$ and $F_2$ which must be applied to achieve sufficient outward distortion of the annular skirt 140 required to permit the locking lugs 132 and 134 to pass over their respective locking tabs 232 and 234. Particularly, the slots 152 and 154 permit the flexible annular bands 152*a* and 154*a* to distort significantly without requiring an equivalent degree of distortion of the annular skirt 140 in a stiffened area adjacent to the internal threads 180. Thus, the lower end 144 of the annular skirt 140 (near which the locking lugs 132 and 134 are disposed) is permitted to distort more freely than the upper end 142 of the annular skirt 140, thereby decreasing the amount of radial forces $F_1$ and $F_2$ required to result in radial distortion of the lower end 144 of the annular skirt 140.

Figure 10:
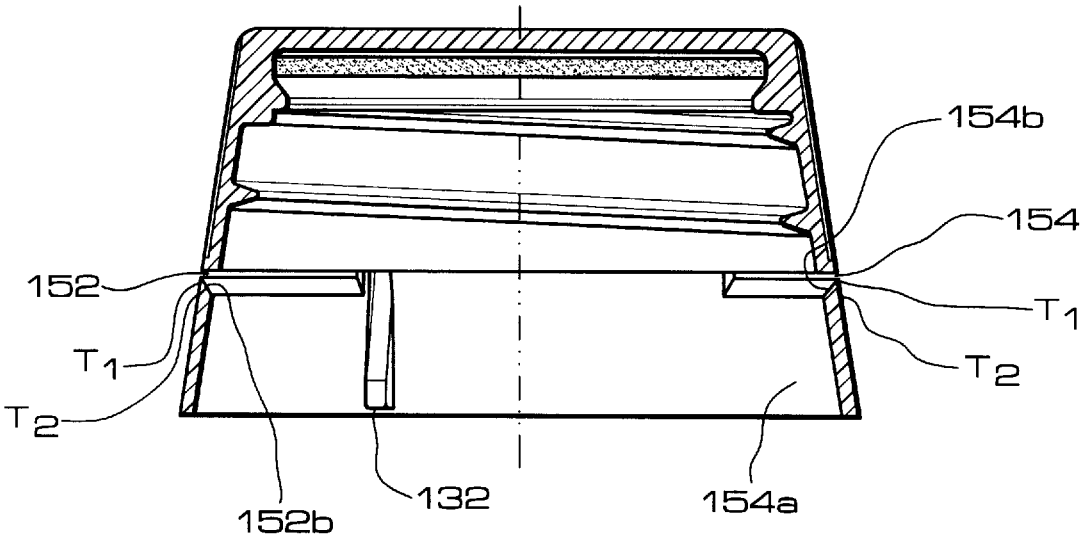

Further, and with reference to FIG. 10, the general wall thickness of the annular skirt 140 in an area near the annular slots 152 and 154 is shown as being downwardly inclined as denoted by reference numerals 152*b* and 154*b* so that the thickness $T_1$ immediately adjacent to the annular slots 152 and 154 is less than the thickness $T_2$ at a line offset from the annular slots 152 and 154 towards the lower end 144 of the annular skirt 140 by a distance. The variable thickness of the annular skirt 140 further enhances the distortion of the annular skirt 140 upon application of the forces $F_1$ and $F_2$.

Further still, the back-angle of the locking lugs 132 and 134 and the locking tabs 232 and 234, provides a tight engagement therebetween, thereby preventing lug "stripping". In the event that removal rotational force is applied to the safety closure 100 without first disengaging the locking lugs 132 and 134 from their respective locking tabs 232 and 234, the interference therebetween is enhanced, still further preventing disengagement.

The foregoing detailed description is given primarily for clearness and understanding and no unnecessary limitations are to be understood therefrom for modifications will become obvious to those skilled in the art upon reading this disclosure and may be made without departing from the spirit of the present invention.

We claim:

1. A safety closure and container assembly, comprising:

a safety closure having (a) a top wall having a lower surface and an outer perimeter, (b) an annular skirt having an inner annular surface, said inner annular surface having an internal thread, (c) at least locking lug, (d) at least one oversized squeeze pad disposed on an outer surface of said annular skirt at a lower end thereof, said squeeze pad being offset from said locking lug by about 90°, said squeeze pad having a thickness greater than a wall thickness of said annular skirt in a region adjacent said squeeze pad, said squeeze pad thickness being continuously greater than said annular skirt wall thickness at all locations thereon, wherein said squeeze pad stiffens the annular side wall near said region adjacent thereto, and, (e) at least one annular slot disposed in a central region of said annular skirt, said slot being unsymmetrically located about said annular skirt between said locking lug and said squeeze pad; and a container having a neck portion, at least one locking tab projecting outwardly from an outer surface of said neck portion, at least one flattened surface disposed on an outer surface of said neck portion, and an external thread provided on said outer surface sized to engage said internal thread of said safety closure, said flattened surface being offset from said locking tabs by about 90°.

2. A safety closure and container assembly according to claim 1, wherein:

said internal thread of said safety closure is provided between said upper end of said annular skirt and said annular slot.

3. A safety closure and container assembly according to claim 2, wherein:

said locking lug including a base end thereof coincident with said inner surface of said annular skirt, said locking lug forming an interior angle of at least 30° with an imaginary line extending inwardly and normally from said inner surface of said annular skirt near said base end.

4. A safety closure and container assembly according to claim 2, wherein:

said squeeze pad having a thickness greater than a wall thickness of said annular skirt in a region between said squeeze pad and said upper end.

5. A safety closure and container assembly according to claim 2, wherein;

said slot being disposed through an arcuate distance of about 75° beginning about 13° said squeeze pad and in the direction of said locking lug.

6. The safety closure and container assembly according to claim 2, wherein:

said safety closure further includes a continuous retaining bead projecting inwardly and downwardly from said inner surface near said upper end;

said container further includes a continuous retaining lip projecting outwardly from a terminal upper end of said neck portion, said retaining lip being sized to engage said retaining bead of said safety closure; and, said retaining bead of said safety closure engages said retaining lip of said container when said safety closure locking lug engages said container locking tab.

7. A safety closure and container assembly according to claim 6, wherein:

said locking lug including a base end thereof coincident with said inner surface of said annular skirt, said locking lug forming an interior angle of at least 30° with an imaginary line extending inwardly and normally from said inner surface of said annular skirt near said base end.

8. A safety closure and container assembly according to claim 6, wherein;

said slot being disposed through an arcuate distance of about 75° beginning about 13° from said squeeze pad and in the direction of said locking lug.

9. The safety closure and container assembly according to claim 1, wherein:

said safety closure further includes a continuous retaining bead projecting inwardly and downwardly from said inner surface near said upper end;

said container further includes a continuous retaining lip projecting outwardly from a terminal upper end of said neck portion, said retaining lip being sized to engage said retaining bead of said safety closure; and, said retaining bead of said safety closure engages said retaining lip of said container when said safety closure locking lug engages said container locking tab.

10. A safety closure and container assembly according to claim 9, wherein:

said locking lug including a base end thereof coincident with said inner surface of said annular skirt, said locking lug forming an interior angle of at least 30° with an imaginary line extending inwardly and normally from said inner surface of said annular skirt near said base end.

11. A safety closure and container assembly according to claim 9, wherein;

said slot being disposed through an arcuate distance of about 75° beginning about 13° from said squeeze pad and in the direction of said locking lug.

12. A safety closure and container assembly according to claim 1, wherein:

said locking lug including a base end thereof coincident with said inner surface of said annular skirt, said locking lug forming an interior angle of at least 30° with an imaginary line extending inwardly and normally from said inner surface of said annular skirt near said base end.

13. A safety closure and container assembly according to claim 1, wherein:

said squeeze pad having a thickness greater than a wall thickness of said annular skirt in a region between said squeeze pad and said upper end.

14. A safety closure and container assembly according to claim 1, wherein;

said slot being disposed through an arcuate distance of about 75° beginning about 13° said squeeze pad and in the direction of said locking lug.

15. A safety closure and container assembly according to claim 1, wherein:

said locking tab including a base end thereof coincident with said outer surface of said container neck, said locking tab forming an interior angle of at least 30 with an imaginary line extending inwardly and normally from said outer surface of said container neck said base end, said locking tab being sized to engage said locking lug.

16. A safety closure and container assembly according to claim 1, wherein said safety closure annular skirt further comprises:

a variable wall thickness.

17. A safety closure and container assembly according to claim 1, wherein:

said safety closure at least one locking lug projects inwardly from said annular surface of said annular skirt at said lower end.

18. A safety closure, comprising:

a top wall having a lower surface and an outer perimeter;

an annular skirt having an inner annular surface, said inner annular surface having an internal thread;

at least one locking lug;

at least one oversized squeeze pad disposed on an outer surface of said annular skirt at a lower end thereof, said squeeze pad being offset from said locking lug by about 90°;

said squeeze pad having a thickness greater than a wall thickness of said annular skirt in a region adjacent said squeeze pad, said squeeze pad thickness being continuously greater than said annular skirt wall thickness at all locations thereon, wherein said squeeze pad stiffens the annular side wall near said region adjacent thereto; and, at least one annular slot disposed in a central region of said annular skirt, said slot being unsymmetrically located about said annular skirt between said locking lug and said squeeze pad.

19. A safety closure according to claim 18, wherein:

said internal thread of said safety closure is provided between said upper end of said annular skirt and said annular slot.

20. A safety closure according to claim 19, further comprising:

a continuous retaining bead projecting inwardly and downwardly from said inner surface near said upper end.

21. A safety closure according to claim 19, wherein:

said locking lug including a base end thereof coincident with said inner surface of said annular skirt, said locking lug forming an interior angle of at least 30° with an imaginary line extending inwardly and normally from said inner surface of said annular skirt near said base end.

22. A safety closure according to claim 19, wherein:

said squeeze pad having a thickness greater than a wall thickness of said annular skirt in a region between said squeeze pad and said upper end.

23. A safety closure according to claim 19, wherein;

said slot being disposed through an arcuate distance of about 75° beginning about 13° from said squeeze pad and in the direction of said locking lug.

24. A safety closure according to claim 18, further comprising:

a continuous retaining bead projecting inwardly and downwardly from said inner surface near said upper end.

25. A safety closure according to claim 24, wherein;

said slot being disposed through an arcuate distance of about 75° beginning about 13° from said squeeze pad and in the direction of said locking lug.

26. A safety closure according to claim 18, wherein:

said locking lug including a base end thereof coincident with said inner surface of said annular skirt, said locking lug forming an interior angle of at least 30° with an imaginary line extending inwardly and normally from said inner surface of said annular skirt near said base end.

27. A safety closure according to claim 18, wherein;

said slot being disposed through an arcuate distance of about 75° beginning about 13° from said squeeze pad and in the direction of said locking lug.

28. A safety closure according to claim 18, wherein said annular skirt further comprises:

a variable wall thickness.

29. A safety closure according to claim 18, wherein:

said safety closure at least one locking lug projects inwardly from said annular surface of said annular skirt at said lower end.

* * * * *

UNITED STATES PATENT AND TRADEMARK OFFICE

CERTIFICATE OF CORRECTION

PATENT NO : 5,836,466

DATED : NOVEMBER 17, 1998

INVENTOR(S): BRIERE, et al.

It is certified that error appears in the above-identified patent and that said Letters Patent is hereby corrected as shown below:

Claim 1 column 6, line 57, insert --one-- after "at least".

Claim 15, column 8, line 46, insert --near-- after "container neck".

Signed and Sealed this

Twenty-seventh Day of April, 1999

*Attest:*

Q. TODD DICKINSON

*Attesting Officer*

*Acting Commissioner of Patents and Trademarks*